US006099359A

United States Patent [19]

Yamamuro

[11] Patent Number: 6,099,359

[45] Date of Patent: Aug. 8, 2000

[54] TERMINAL RETENTION SYSTEM

[75] Inventor: Hirokuni Yamamuro, Yokohama, Japan

[73] Assignee: Molex Incorporated, Lisle, Ill.

[21] Appl. No.: 09/096,146

[22] Filed: Jun. 11, 1998

[30] Foreign Application Priority Data

Jun. 20, 1997 [JP] Japan ..... 9-180674

[51] Int. Cl.[7] ..... H01R 13/405

[52] U.S. Cl. ..... 439/736; 439/660

[58] Field of Search ..... 439/736, 660

[56] References Cited

U.S. PATENT DOCUMENTS

| | | | |
|---|---|---|---|
| 2,820,209 | 1/1958 | Whitted | 339/125 |
| 4,530,557 | 7/1985 | Katsube et al. | 339/75 |
| 4,762,507 | 8/1988 | Rudy, Jr. et al. | 439/595 |
| 4,884,980 | 12/1989 | Bensing et al. | 439/606 |
| 5,030,138 | 7/1991 | Capp et al. | 439/497 |
| 5,176,541 | 1/1993 | Mori | 439/736 |
| 5,201,883 | 4/1993 | Atoh et al. | 29/883 |
| 5,330,372 | 7/1994 | Pope et al. | 439/692 |
| 5,772,474 | 6/1998 | Yagi et al. | 439/736 |

FOREIGN PATENT DOCUMENTS

| | | | |
|---|---|---|---|
| 0 450 770 A1 | 3/1991 | European Pat. Off. | H01R 23/68 |
| 0 693 802 A2 | 7/1995 | European Pat. Off. | H01R 23/70 |

*Primary Examiner*—Gary F. Paumen
*Assistant Examiner*—Briggitte Hammond
*Attorney, Agent, or Firm*—Charles S. Cohen

[57] ABSTRACT

An electrical connector includes a dielectric housing of molded plastic material, with a mating portion having a generally planar mating face. At least one conductive terminal has a contact portion with a contact face generally flush with the mating face of the housing. The terminal has an outwardly projecting retention flange remote from the contact face of the housing and embedded in the molded plastic material of the housing to prevent the contact portion of the terminal from pulling away from the mating face of the housing.

16 Claims, 5 Drawing Sheets

TERMINAL RETENTION SYSTEM

FIELD OF THE INVENTION

This invention generally relates to the art of electrical connectors and, particularly, to a connector having terminals retained by an overmolded housing.

BACKGROUND OF THE INVENTION

Generally, a typical electrical connector includes an insulating or dielectric housing defining some form of mating configuration for mating the connector with a complementary mating connector or other connecting device. For example, the connector housing may define a male or plug connector, or the connector housing may define a female or socket connector. The dielectric housing may be a standalone component, or it may be adapted for mounting on a printed circuit board, in a panel or in association with other mounting structures.

One or more conductive terminals are mounted on or in the connector housing. The terminals can have a very wide range of configurations depending on the use of the connector. However, the terminals typically have contact portions for engaging the contact portions of terminals in the complementary mating connecting device. One type of terminal is a stamped and formed terminal of sheet metal material, and such terminals may have a contact leg or blade of flat sheet metal material.

Some form of retention system must be employed to hold the terminals on or in the connector housing. The retention systems also vary widely. The terminals may be press-fit into terminal-receiving cavities, or the terminals may have latching portions for latching with complementary latches on the connector housing. One form of retention system involves overmolding a plastic housing about portions of the terminals to rigidify and hold the terminals on the housing.

One problem with overmolded terminals as described above concerns retaining the terminals on the housing when the housing does not completely embrace portions of the terminals. In other words, the dielectric housing may be of molded plastic material and have a mating portion defining a generally planar mating face of the connector. The terminals, such as stamped and formed sheet metal terminals, may have contact legs with faces generally flush with the mating face of the overmolded housing. Such terminals have a tendency to pull out of the housing, because the housing does not encapsulate portions of the terminals. For instance, a stamped and formed terminal may have a contact leg or blade which simply is embedded in the overmolded housing, with a contact face of the blade flush with the mating face of the housing, and the blade has no positive retention means to prevent it from pulling out of the housing during use. The present invention is directed to solving these problems in an electrical connector which includes a dielectric housing overmolded about metal terminals.

SUMMARY OF THE INVENTION

An object, therefore, of the invention is to provide an electrical connector with a new and improved terminal retention system.

In the exemplary embodiment of the invention, the connector generally includes a dielectric housing having a mating portion with a mating face. At least one conductive terminal has a contact portion with a contact face exposed at the mating face of the housing. A retention tab is formed on the contact portion remote from the contact face and is embedded in the housing to prevent the contact portion from pulling away from the mating face of the housing.

As disclosed herein, the housing is of molded plastic material, and the mating portion has a generally planar mating face. The terminal is a stamped and formed sheet metal terminal at least partially overmolded by the housing. The contact face of the terminal is generally flush with the mating face of the housing. The remote face of the terminal is embedded in the molded plastic material of the housing. Side edges of the terminal extend between the contact face and the remote face. One of the retention tabs projects outwardly from each side edge of the terminal, spaced inwardly of the mating face of the housing, whereby the retention tabs are encapsulated by the molded plastic material of the housing.

The terminals herein are configured to have elongated contact legs defining the contact faces thereof. The retention tabs comprise retention flanges running longitudinally along opposite edges of the contact legs. In fabrication, the retention flanges are stamped from the opposite edges of the contact legs.

Another feature of the invention is that each terminal includes a distal end bent at an angle to the contact leg. The distal end has a generally arrowhead configuration embedded in the molded plastic material of the housing.

A further feature of the invention is that the bent distal end defines an elbow with the contact leg. The inside of the elbow has an enlarged pocket filled with the molded plastic material of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
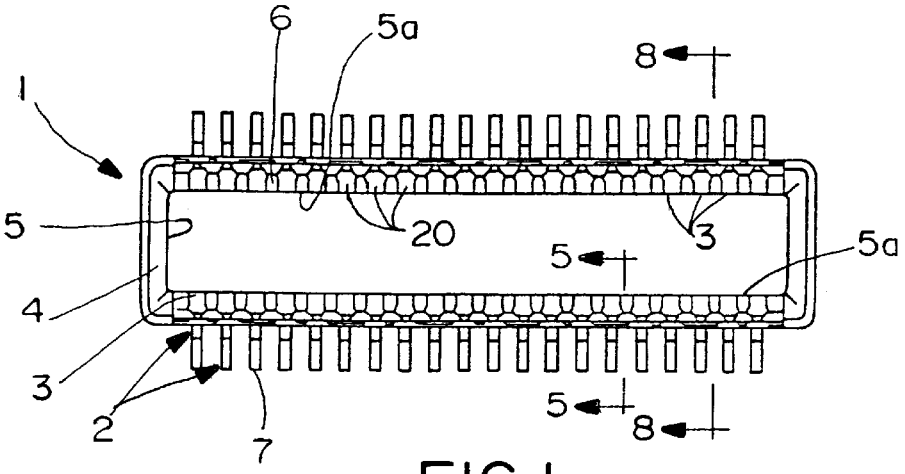
FIG. 1 is a top plan view of an electrical connector embodying the concepts of the invention.

Referring to the drawings in greater detail, and first to FIGS. 1–4, the invention is embodied in an electrical connector, generally designated 1, which mounts a plurality of terminals, generally designated 2. The terminals have contact portions 3 defining contact faces exposed along opposite sides of a socket 5 as best seen in FIG. 1. The socket is adapted for receiving a complementary mating connecting device inserted thereinto. The opposite sides of the socket define generally planar mating faces 5*a*. The socket is defined by a dielectric housing 4 of molded plastic material. The housing defines a mating end 6.

Figure 3:
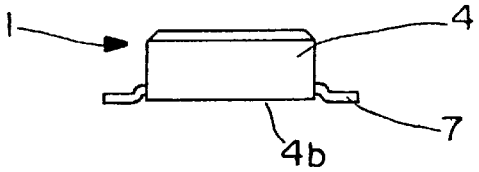
FIG. 3 is an end elevational view of the connector.
Figure 4:
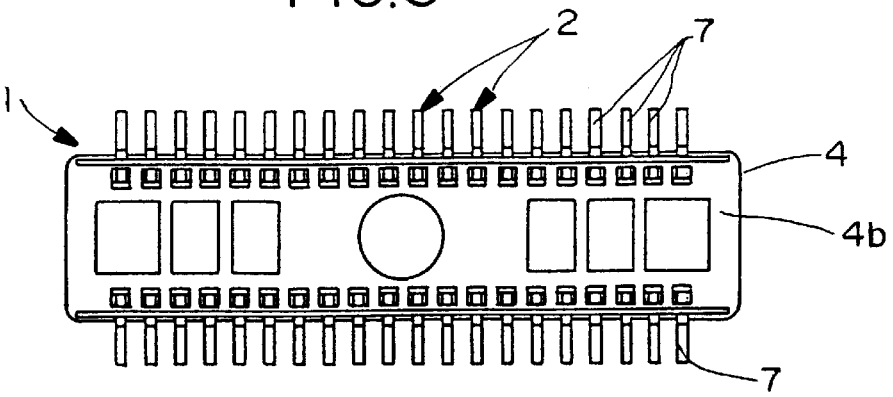
FIG. 4 is a bottom plan view of the connector.

Housing 4 of connector 1 has a bottom face 4*b* as seen best in FIGS. 3 and 4 for surface mounting on a printed circuit board. Terminals 2 have feet 7 for connection, as by soldering, to appropriate circuit traces on the printed circuit board. Feet 7 of terminals 2 are generally flush with bottom 4*b* of housing 4 as best seen in FIG. 3.

Figure 11:
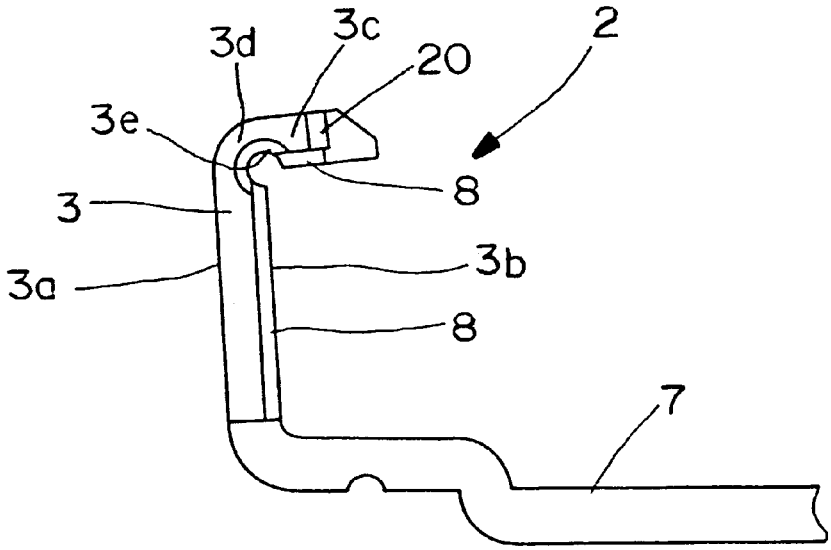
FIG. 11 is an enlarged side elevational view of one of the terminals.

FIG. 11 shows one of the terminals 2. The terminals are stamped and formed of sheet metal material. The terminals include the contact portion or leg 3, along with solder foot 7. The contact leg defines a contact face 3*a* and a back or remote face 3*b*. A distal end 3*c* of the terminal is bent generally at a right-angle to contact leg 3 to define an elbow 3*d*. An enlarged pocket 3*e* is formed at the inside of the elbow. As will be seen in greater detail hereinafter, retention tabs or flanges 8 extend along the outside edges of remote face 3*b* of contact leg 3*a* as well as the remote or inside face of distal end 3*c*.

Figure 5:
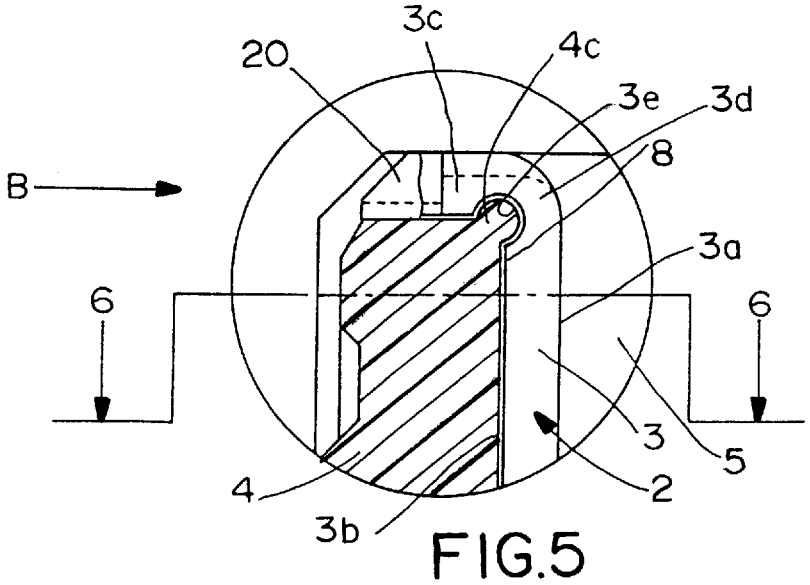
FIG. 5 is a fragmented vertical section, on an enlarged scale, taken generally along line 5—5 of FIG. 1.
Figure 6:
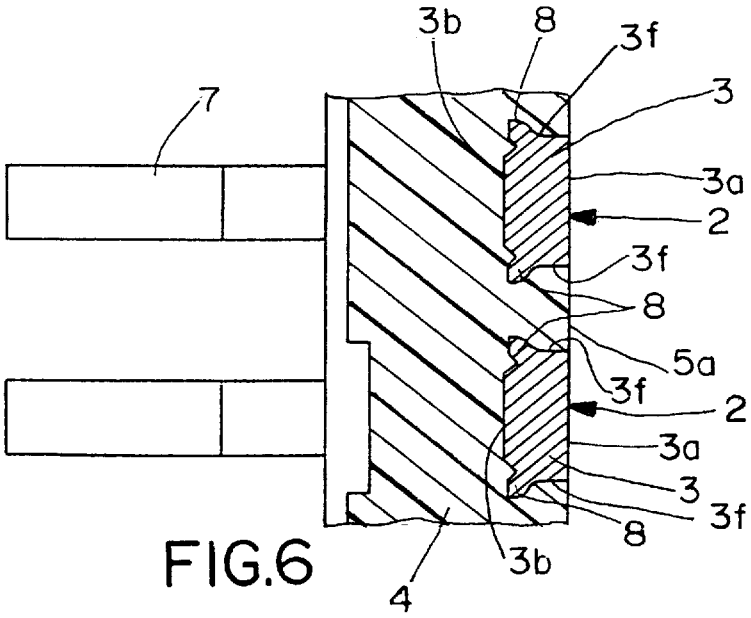
FIG. 6 is a fragmented section taken generally along line 6—6 of FIG. 5.
Figure 7:
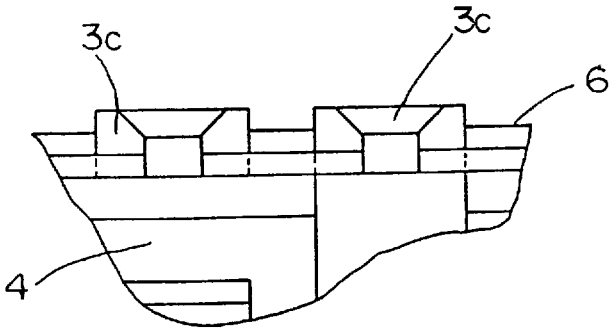
FIG. 7 is a fragmented side elevational view looking in the direction of arrow "B" in FIG. 5.
Figure 8:
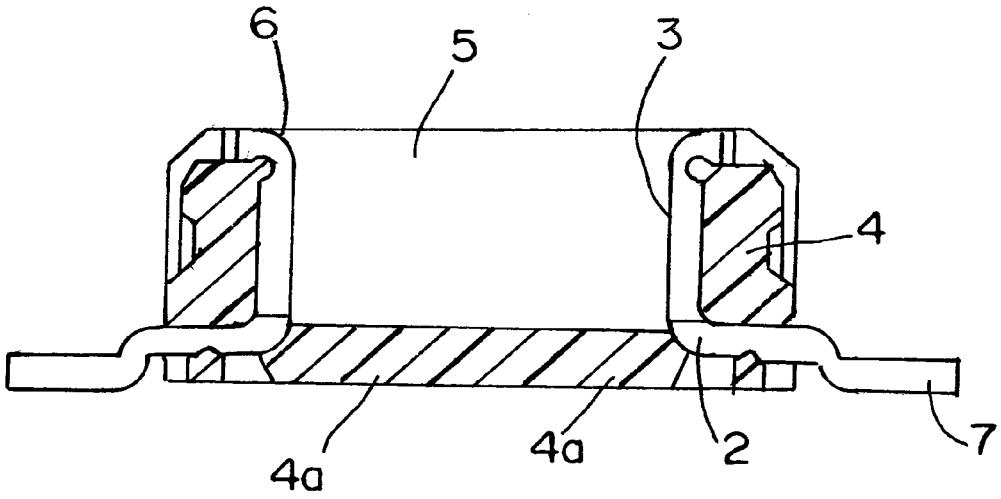
FIG. 8 is a vertical section taken generally along line 8—8 of FIG. 1.

FIGS. 5–7 show various views of how terminals 2 are overmolded within the plastic material of molded dielectric housing 4. Turning first to FIG. 5, it can be seen that plastic material 4*c* is disposed within enlarged pocket 3*e* behind elbow 3*d* of each terminal. This interiorly captured plastic material contributes to retaining the terminal on the housing.

FIG. 6 best shows that contact faces 3*a* of terminals 2 are generally flush with the generally planar mating face 5*a* within socket 5 of molded plastic housing 4. Side edges 3*f* extend between contact face 3*a* and back or remote face 3*b* of each terminal. It can be seen that the remote face 3*b* of each terminal is completely embedded within the molding plastic material of housing 4.

Still referring to FIG. 6, it can be seen that retention tabs or flanges 8 are remote from contact face 3*a* of each terminal and, therefore, remote from mating face 5*a* of the molded plastic housing. The retention flanges project outwardly from side edges 3*f* of the terminals and are completely surrounded by the molded plastic material of the housing to securely retain the terminals on the housing. In essence, retention flanges 8 project outwardly from the rear corners of the terminals between back or remote faces 3*b* and side edges 3*f* of the terminals.

Figures 10A, 10B, 10C:
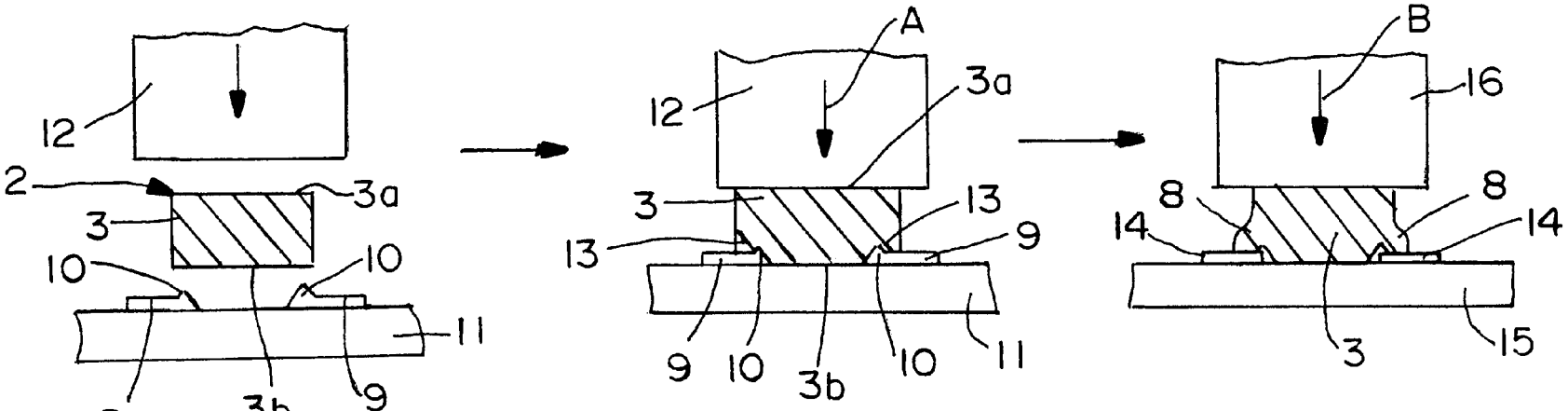
FIGS. 10A–10C are sequential views illustrating the stamping of the retention flanges of the terminals.

FIGS. 10A–10C show sequential views of how retention flanges 8 are preferably formed from contact legs 3 of terminals 2. Turning first to FIG. 10A, it can be seen that contact leg or blade 3 is positioned over a pair of forming dies 9 having sharp edges 10. The forming dies are fixed to the top of an anvil or other support structure. The contact blade is positioned between the forming dies and a press 12, with mating face 3*a* of the contact blade facing the press.

Turning to FIG. 10B, press 12 is forced downwardly in the direction of arrow "A" to cause sharp edges 10 of forming dies 9 to cut into remote face 3*b* of the contact blade at the edges thereof, as press die 12 engages mating face 3*a* of the contact blade. Basically, the sharp cutting edges 10 of forming dies 9 are effective to shear portions 13 of the contact blade at the corners of the contact blade between the side edges thereof and the back or remote face 3*b*.

The sheared contact leg or blade then is moved to a spreading station as shown in FIG. 10C where contact blade 3 is positioned on top of a pair of spreading blocks 14 fixed to the top of an anvil or other support structure 15. A press 16 is forced downwardly in the direction of arrow "B", and the sheared portions 13 (FIG. 10B) are spread outwardly as shown in FIG. 10C to form the outwardly projecting retention flanges 8 described above and shown most clearly in FIG. 6.

Figure 2:
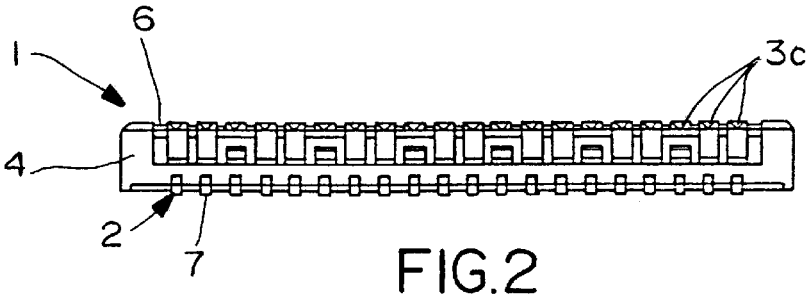
FIG. 2 is a side elevational view of the connector.
Figure 9:
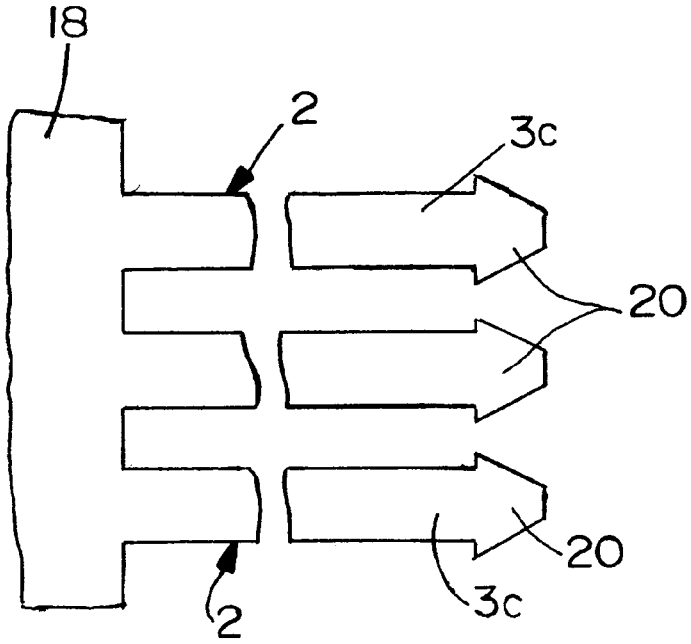
FIG. 9 is a fragmented plan view of the distal ends of a plurality of the terminals after a stamping operation.
Figure 12:
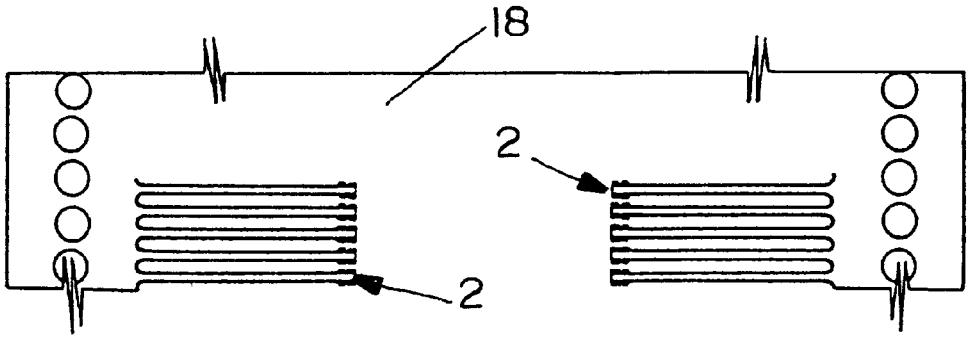
FIG. 12 is a plan view of a blank of sheet metal material from which the terminals are stamped and formed.

FIGS. 9 and 12 show that a plurality of terminals 2 are stamped and formed from a continuous length of sheet metal material 18. As seen best in FIG. 9, distal ends 3*c* are stamped with arrowhead configurations as indicated at 20. The location of the arrowhead configurations 20 relative to the remainder of the terminals is shown in FIGS. 5 and 11. Distal ends 3*c* of the terminals are embedded in the plastic material at the top of end face 6 of housing 4 as best seen in FIGS. 1, 2 and 7. The distal ends are overmolded within the molded plastic material at end face 6, and the arrowhead configurations of the distal ends further prevent the terminals from pulling out of the plastic material of the housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a dielectric housing of molded plastic material, with a mating portion having a generally planar mating face; and at least one stamped and formed sheet metal terminal at least partially overmolded by said housing, the terminal including a contact face, a portion of the contact face being generally flush with the mating face of the housing, a remote face embedded in the molded plastic material of the housing, side edges extending between the contact face and the remote face, and at least one retention tab projecting outwardly from each side edge, said retention tabs being spaced inwardly of the contact face of the terminal whereby the retention tabs are encapsulated by the molded plastic material of the housing.

2. The electrical connector of claim 1 wherein said terminal includes a contact leg defining said contact face and a distal end bent at an angle to the contact leg, the distal end having a generally arrowhead configuration embedded in the molded plastic material of the housing.

3. The electrical connector of claim 1 wherein said mating portion of the housing comprises a socket for receiving a complementary mating connection device, said mating face is on the inside of the socket, and including a plurality of said terminals having contact faces spaced along the mating face of the socket.

4. The electrical connector of claim 1 wherein the contact face of said terminal extends along an elongated contact leg of the terminal, and said retention tabs comprise retention flanges running longitudinally along opposite edges of the contact leg.

5. The electrical connector of claim 4 wherein said retention flanges are stamped from the opposite edges of the contact leg.

6. The electrical connector of claim 1 wherein said terminal includes a contact leg defining said contact face and a distal end bent at an angle to the contact leg at an elbow, an inside of the elbow having an enlarged pocket filled with the molded plastic material of the housing.

7. The electrical connector of claim 6 wherein said distal end of the terminal has a generally arrowhead configuration embedded in the molded plastic material of the housing.

8. An electrical connector, comprising:

a dielectric housing of molded plastic material and having a mating portion including a socket for receiving a complementary mating connecting device, with a generally planar mating face on the inside of the socket; and a plurality of stamped and formed sheet metal terminals having elongated contact legs overmolded in the mating face of the housing, each contact leg of each terminal having a contact face generally flush with the mating face of the housing, a remote face embedded in the molded plastic material of the housing, side edges extending between the contact face and the remote face, and a pair of retention flanges running longitudinally along the opposite side edges of the contact leg and projecting outwardly from the side edges, said retention flanges being spaced inwardly of the mating face of the housing whereby the retention flanges are encapsulated by the molded plastic material of the housing.

9. The electrical connector of claim 8 wherein said housing has an end face at an angle to said mating face, and said terminals include distal ends bent at angles to the contact legs thereof, the distal ends having generally arrowhead configurations embedded in the molded plastic material of the end face of the housing.

10. The electrical connector of claim 8 wherein said housing has an end face at an angle to the mating face of the housing, and said terminals have distal ends bent at angles to the contact legs of the terminals to define elbows, the insides of the elbows having enlarged pockets filled with the molded plastic material of the housing.

11. The electrical connector of claim 10 wherein said distal ends of the terminals have generally arrowhead configurations embedded in the molded plastic material at the end face of the housing.

12. An electrical connector, comprising:

a dielectric housing having a mating portion with a mating face; and at least one conductive terminal having a contact portion with a contact face exposed at the mating face of the housing and a retention tab on the contact portion, remote from the contact face and embedded in the housing to prevent the contact portion from pulling away from the mating face of the housing, wherein said terminal includes a contact leg defining said contact face and a distal end bent at an angle to the contact leg at an inside of the elbow having an enlarged pocket filled with material of the housing.

13. The electrical connector of claim 12 wherein said contact portion comprises an elongated contact leg of the terminal, and said retention tab comprises a retention flange running longitudinally of the contact leg.

14. The electrical connector of claim 12 wherein said terminal includes a contact leg defining said contact face and a distal end bent at an angle to the contact leg, the distal end having a generally arrowhead configuration embedded in the housing.

15. The electrical connector of claim 12 wherein said mating portion of the housing comprises a socket for receiving a complementary mating connection device, said mating face is on the inside of the socket, and including a plurality of said terminals having contact faces spaced along the mating face of the socket.

16. The electrical connector of claim 12 wherein said distal end of the terminal has a generally arrowhead configuration embedded in the material of the housing.

* * * * *